United States Patent [19]

Tanaka et al.

[11] Patent Number: 4,976,305

[45] Date of Patent: Dec. 11, 1990

[54] METHOD OF AND APPARATUS FOR CONTROLLING DIE TEMPERATURE IN LOW-PRESSURE CASTING PROCESS

[75] Inventors: Kouji Tanaka; Syugo Kondo; Takeshi Imura; Katsuhiko Ando; Shigemitsu Nakabayashi, all of Sayama, Japan

[73] Assignee: Honda Giken Kogyo Kabushiki Kaisha, Tokyo, Japan

[21] Appl. No.: 278,458

[22] Filed: Dec. 1, 1988

[30] Foreign Application Priority Data

Dec. 1, 1987 [JP] Japan ..... 62-303952
Dec. 1, 1987 [JP] Japan ..... 62-303953
Dec. 1, 1987 [JP] Japan ..... 62-303954

[51] Int. Cl.[5] ..... B22D 18/04; B22D 30/00
[52] U.S. Cl. ..... 164/458; 164/154
[58] Field of Search ..... 164/119, 306, 457, 458, 164/154, 155, 122, 4.1, 348

[56] References Cited

U.S. PATENT DOCUMENTS 3,583,467 6/1971 Bennett et al. ..... 164/458
4,213,494 7/1980 Carbonnel ..... 164/457
4,671,342 6/1987 Balevski et al. ..... 164/154

FOREIGN PATENT DOCUMENTS 59-82143 5/1984 Japan ..... 164/154
59-127965 7/1984 Japan ..... 164/154
229834 3/1925 United Kingdom .
1297108 5/1969 United Kingdom .
2080166 10/1980 United Kingdom .

*Primary Examiner*—Richard K. Seidel

[57] ABSTRACT

The temperature of a casting die is controlled in a low-pressure casting process for pressurizing the surface of molten metal stored in a closed container to fill the molten metal in a die cavity defined in the casting die. The temperature of the casting die is detected by a temperature sensor, and compared with a preset reference die temperature range. The amount of cooling water to be supplied to the casting die is controlled based on the result of the comparison. When the detected temperature of the casting die falls in the preset reference die temperature range, the molten metal starts to be filled in the die cavity.

43 Claims, 9 Drawing Sheets

METHOD OF AND APPARATUS FOR CONTROLLING DIE TEMPERATURE IN LOW-PRESSURE CASTING PROCESS

BACKGROUND OF THE INVENTION

The present invention relates to a method of and an apparatus for controlling the temperature of a die in a low-pressure casting process, and more particularly to a method of and an apparatus for controlling the temperature of a die in a low-pressure casting process by detecting die temperatures respectively in the various steps of a casting cycle which include a step from the clamping of the die to the starting of pouring molten metal into the die, a step of filling the molten metal in the die, and a step after the filling of the molten metal until the opening of the die, and by controlling the cooling of the die according to an optimum cooling pattern, so that the quality of the cast product will be stable and high irrespective of different casting cycles which the die undergoes.

Generally, the low-pressure casting process is widely employed for mass-producing automotive parts or the like. In the low-pressure casting process, molten light alloy (hereinafter referred to as "molten metal") such as an aluminum alloy or the like is heated and held in a sealed container, and the surface of the molten metal in the container is pressurized by an inert gas or air under a relatively low pressure to force the molten metal via a feed pipe into a die cavity defined in a die for casting a product.

During the low-pressure casting process, cooling water is supplied to the die to control the temperature of the die which is associated with a temperature sensor. When the actual temperature of the die as detected by the temperature sensor is higher than a reference temperature, cooling water is supplied to the die. When the detected die temperature is lower than the reference temperature, the supply of cooling water is stopped. In this manner, the temperature of the die is kept in a certain temperature range.

The casting machine for carrying out the casting process necessarily has certain downtimes when the casting is removed after the die has been opened when the die is cleaned after the casting has been taken out, and when sand cores are set in the die. One casting cycle may also be interrupted by a trouble with the die or a trouble caused by an erroneous action of the operator. Usually, therefore, the casting process contains different or irregular casting cycle.

If the intervals between the steps of pouring molten metal into the die in the respective different casting cycles differ from each other, then the initial temperatures of the die when starting to pour the molten metal also differ from each other in the respective casting cycles. The different initial temperatures in the respective casting cycles result in different patterns in which the temperatures of the die and the molten metal vary in the stage of filling the molten metal in the die cavity and solidifying the molten metal under pressure.

The aforesaid temperature control method cannot effectively cope with varying conditions in the different casting cycles. More specifically, cooling water is supplied or interrupted solely based on the reference die temperature regardless of how each casting cycle proceeds through the steps thereof. Since the temperature conditions of the die in the respective casting cycles are not constant, the castings produced by the casting process do not have uniform quality, and sometimes defective castings may be produced because of unexpected conditions resulting from the different casting cycles.

SUMMARY OF THE INVENTION

In view of the aforesaid shortcomings of the conventional die temperature control method, it is a general object of the present invention to provide a method of and an apparatus for controlling the temperature of a die in a low-pressure casting process based on the actual temperature of the die so that the die temperature will vary according to an optimum cooling pattern, thereby to allow molten metal to be solidified under optimum control without being adversely affected by different casting cycles.

Another object of the present invention is to provide a method of controlling the temperature of a casting die in a low-pressure casting process for pressurizing the surface of molten metal stored in a closed container to fill the molten metal in a die cavity defined in the casting die, said method comprising the steps of: detecting the temperature of said casting die before the molten metal is filled in said die cavity under pressure; comparing said detected temperature of the casting die and a preset reference die temperature range to determine whether said detected temperature of falls within the preset reference die temperature range; controlling the amount of cooling water to be supplied to said casting die based on the result of the comparing step; and starting to fill the molten metal in said die cavity when said detected temperature of the casting die falls in said preset reference die temperature range.

Still another object of the present invention is to provide a method of controlling the temperature of a die in a low-pressure casting process, wherein a plurality of temperature zones higher than said preset reference die temperature range are established, and the casting die is cooled by repeatedly controlling the amount of cooling water to be supplied to the casting die dependent on which one of the temperature zones said detected temperature falls in.

Yet another object of the present invention is to provide a method of controlling the temperature of a casting die in a low-pressure casting process for pressurizing the surface of molten metal stored in a closed container to fill the molten metal in a die cavity defined in the casting die, said method comprising the steps of: detecting the temperature of said casting die when the molten metal is filled in said die cavity under pressure; selecting, dependent on said detected temperature of the casting die, an optimum one of a plurality of molten metal pressurizing patterns established dependent on die temperatures and an optimum one of a plurality of die cooling patterns established dependent on die temperatures; filling and holding the molten metal in said die cavity under a pressure according to the selected molten metal pressurizing pattern; and supplying said casting die with an amount of cooling water which is variably controlled according to the selected die cooling pattern.

Yet still another object of the present invention is to provide a method of controlling the temperature of a die in a low-pressure casting process, wherein said molten metal pressurizing patterns are established such that a time period for pressurizing the molten metal is shorter when the die temperature is lower, and is longer when the die temperature is higher.

Still another object of the present invention is to provide a method of controlling the temperature of a die in a low-pressure casting process, wherein said molten metal pressurizing patterns are established such that a speed at which the molten metal is fed into said die cavity is higher when the die temperature is lower, and is lower when the die temperature is higher.

A further object of the present invention is to provide a method of controlling the temperature of a die in a low-pressure casting process, wherein the temperature of the casting die and the temperature of the molten metal are detected, and an optimum one of the molten metal pressurizing patterns and an optimum one of the die cooling patterns are selected dependent on said detected temperature of the casting die and said detected temperature of the molten metal.

A yet further object of the present invention is to provide a method of controlling the temperature of a casting die in a low-pressure casting process for pressurizing the surface of molten metal stored in a closed container to fill the molten metal in a die cavity defined in the casting die, said method comprising the steps of: detecting the temperature of said casting die after the molten metal is filled in said die cavity under pressure; determining a reference die temperature corresponding to said detected temperature of the casting die from a predetermined die cooling curve; selecting an amount of cooling water to be supplied to said die cavity based on the difference between said detected temperature of the casting die and said reference die temperature; and supplying said selected amount of cooling water to said casting die to cool the casting die according to said die cooing curve.

A still further object of the present invention is to provide a method of controlling the temperature of a die in a low-pressure casting process, wherein the temperature of said casting die is lowered to a prescribed die-opening temperature by repeatedly starting to pressurize the molten metal after a preset temperature of the casting die is detected, detecting the temperature of the casting die at prescribed intervals of time after the molten metal is filled in said die cavity, and comparing the temperature of the casting die and said reference die temperature.

It is also an object of the present invention to provide an apparatus for controlling the temperature of a casting die so as to fall in a prescribed temperature range by supplying cooling water to the casting die in a low-pressure casting process for pressurizing the surface of molten metal stored in a closed container with a gas under pressure to fill the molten metal in a die cavity defined in the casting die, said apparatus comprising: a temperature sensor disposed in said casting die for detecting the temperature of the casting die; flow control means comprising a fluid circuit including a solenoid valve and a variable restriction valve for determining an amount of cooling water to be supplied to the casting die; and a microcomputer for controlling said solenoid-operated valve based on a signal applied from said temperature sensor.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENT

Figure 1:
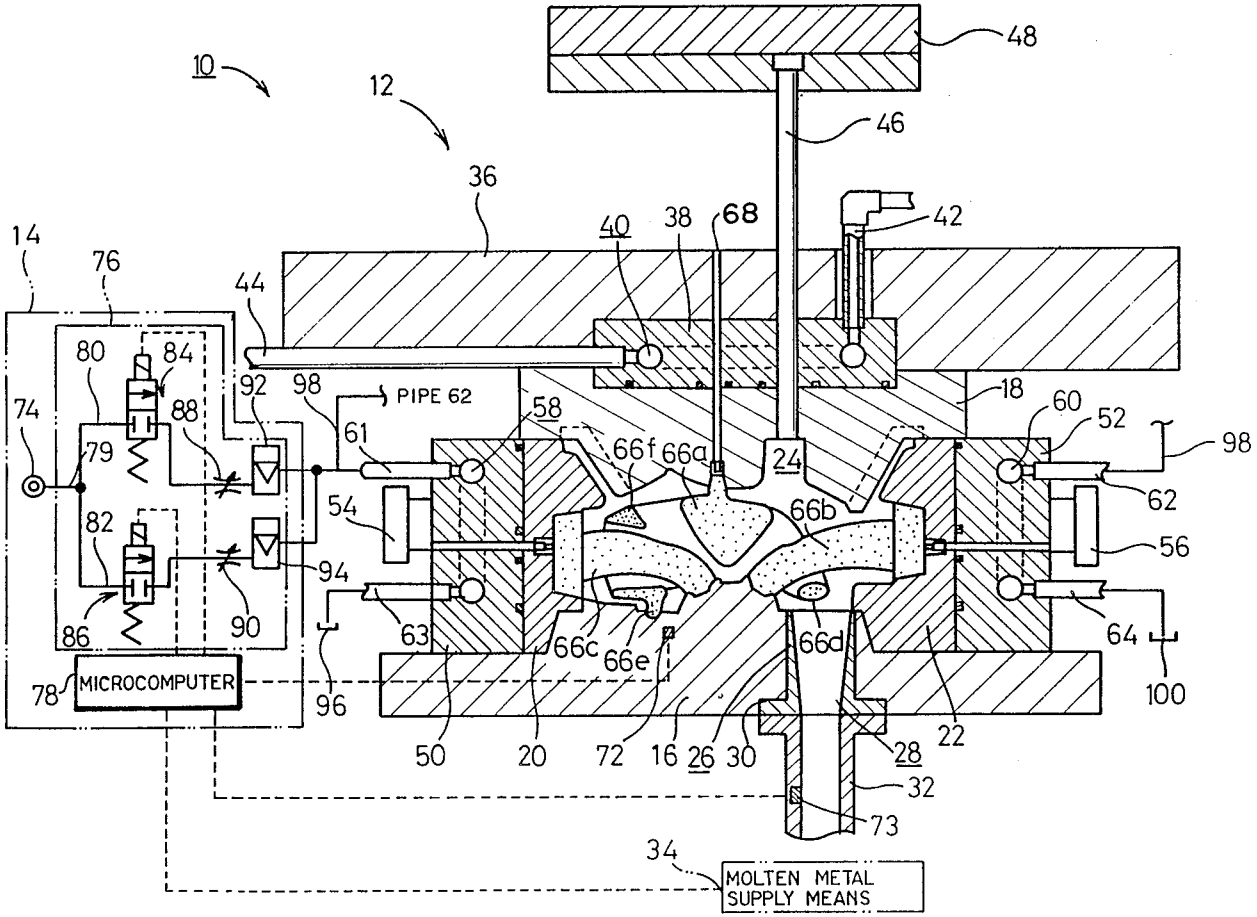
FIG. 1 is a vertical cross-sectional view, partly in block form, of a die casting apparatus for carrying out a die temperature control method according to the present invention.

FIG. 1 shows a die casting apparatus, generally designated by the reference numeral 10, basically comprising a casting die 12 and a die temperature control apparatus 14.

The casting die 12 includes a lower die member 16, an upper die member 18 disposed above the lower die member 16, and slidable die members 20, 22 slidably fitted between the lower and upper dies 16, 18. The lower die 16, the upper die 18, and the slidable dies 20, 22 jointly define a die cavity 24 therebetween which has a three-dimensional shape for casting the cylinder head of an automotive internal combustion engine, for example.

The lower die member 16 has a stepped hole 26 defined vertically therein. A nozzle 30 is mounted in the stepped hole 26 and has a sprue 28 communicating with the die cavity 24. The nozzle 30 is connected to a stalk 32 through which molten metal flows, the stalk 32 being connected to a molten metal supply 34 disposed below the lower die member 16. The molten metal supply 34 includes a closed ladle (not shown) for holding molten metal at a desired temperature.

The upper die member 18 is fixed to a movable die base 36 and vertically movable in response to operation of an actuator (not shown) connected to the movable die base 36. Between the movable die base 36 and the upper die member 18, there is disposed a cooling block 38 secured to the upper die member 18 by bolts or the like. The cooling block 38 has a cooling hole or passage 40 defined therein for receiving cooling water therein. The cooling water can be introduced into and discharged from the cooling hole 40 through pipes 42, 44 inserted in the movable die base 36. An ejector pin 46 for knocking out a casting when the die 12 is opened is inserted through the upper die member 18 and the movable die base 36. The ejector pin 46 has one end mounted in an attachment member 48 disposed above the movable die base 36 and the opposite end facing into the die cavity 24.

Cooling blocks 50, 52 are disposed in close contact with the rear surfaces of the slidable die members 20, 22, respectively, which are slidably fitted between the upper and lower dies 18, 16. The cooling blocks 50, 52 are connected to actuators (not shown) through connectors 54, 56, respectively. The cooling blocks 50, 52 have cooling holes or passages 58, 60, respectively, which are held in communication with pipes 61, 62, respectively, for supplying cooling water into the cooling holes 58, 60 and also with pipes 63, 64, respectively, for discharging cooling water from the cooling holes 58, 60.

Sand cores **66*a* through 66*f* are disposed in the die cavities 24. A vent hole 68 for discharging a gas from the die cavity 24 is defined through the upper die member 18, the cooling block 38, and the movable die base 36**.

The die temperature control apparatus 14 for controlling the temperature of the casting die 12 according to the present invention comprises a first temperature sensor 72 disposed in the lower die member 16 near the die cavity 24 in the form of a thermocouple, for example, for detecting the temperature of the die 12, a second temperature sensor 73 disposed in the stalk 32 for detecting the temperature of molten metal as it flows through the stalk 32, a flow control means 76 for controlling the rate of flow of cooling water supplied from a cooling water supply 74, and a microcomputer 78 operable based on data applied as output voltages from the first and second temperature sensors 72, 73 for opening and closing valves in the flow control means 76 and for controlling the molten metal supply 34.

The flow control means 76 comprises a fluid circuit including solenoid-operated valves and variable restriction valves. More specifically, a pipe 79 extending from the cooling water supply 74 is branched off into secondary pipes 80, 82 having respective solenoid-operated valves 84, 86 which are selectively openable and closable by an opening signal or a closing signal issued by the microcomputer 78.

Variable restriction valves 88, 90 and flowmeters 92, 94 are connected to and disposed downstream of the solenoid-operated valves 84, 86. The pipes 80, 82 from the flowmeters 92, 94 are joined to each other and to the pipe 61 inserted in the cooling block 50 disposed behind the slidable die member 20. Cooling water introduced from the pipe 61 into the cooling hole 58 is then discharged through the pipe 63 into a tank 96.

Cooling water supplied via the die temperature control apparatus 14 is also introduced through a pipe 98 into the cooling block 52 disposed behind the slidable die member 22, and then discharged via the pipe 64 into a tank 100. While the cooling water is supplied to cool the slidable die members 20, 22 in the illustrated embodiment, it may also be supplied to the cooling block 38 associated with the upper die member 18 dependent on casting conditions, the size of a casting to be produced, and other conditions.

Using the die casting apparatus 10 thus constructed, an engine cylinder head is cast from a molten aluminum alloy (hereinafter referred to as "molten metal") classified as JIS AC2B under the following casting conditions: the temperature of the molten metal is 700° C. and the molten metal is pressurized under 0.28 kg/cm$^2$ when forced into the die cavity 24.

The die temperature control method according to the present invention contains the following three die temperature control processes which are to be effected in the respective steps of a casting cycle: The first die temperature control process controls the temperature of the die 12 during a step from the clamping of the die to the starting of the supply of molten metal into the die cavity 24. The second die temperature control process controls the temperature of the die 12 when molten metal is filled in the die cavity 24 under pressure. The third die temperature control process controls the temperature of the die 12 during a step after the molten metal has been filled in the die cavity 24 until the die 12 is opened. The above three die temperature control processes are carried out continuously in the sequence of one casting cycle by the die temperature control apparatus 14. Each of the three die temperature control processes will now be described according to a time-dependent sequence of the casting cycle.

The sand cores **66*a* through 66*f* are placed in the die cavity 24, and then the movable die base 36 and the upper die 18 are displaced downwardly by the actuator connected to the movable die base 36. At the same time, the slidable dies 20, 22 are displaced toward each other by the actuators connected to the cooling blocks 50, 52 through the connectors 54, 56**.

Figure 2:
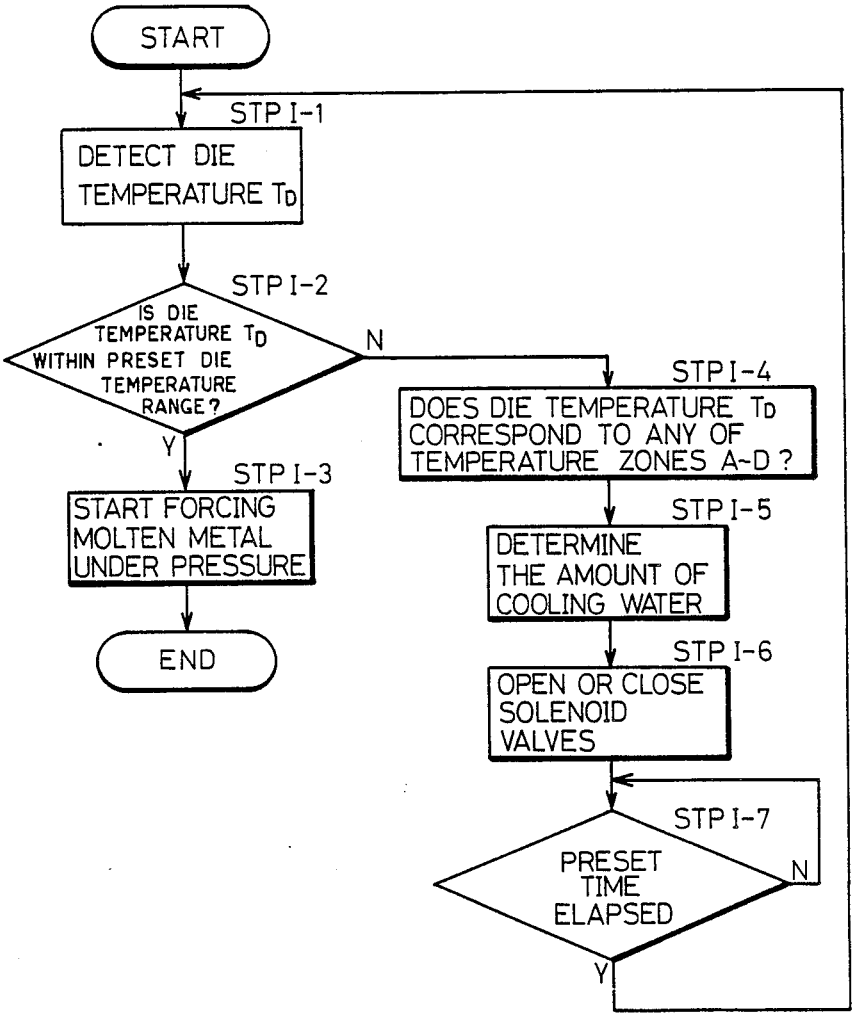
FIG. 2 is a flowchart of a sequence of a first die temperature control process of the die temperature control method.

FIG. 2 shows a sequence of the first die temperature control process of the invention. Before the die cavity 24 is filled with molten metal under pressure while carrying out the first die temperature control process, the temperature of the die 12 is adjusted in advance to a temperature range which is best suited to the casting conditions. The microcomputer 78 of the die temperature control apparatus 14 includes a ROM which stores a program containing instructions for the sequence of FIG. 2. The CPU of the microcomputer 78 is operated by the stored program to carry out the sequence.

Figure 3:
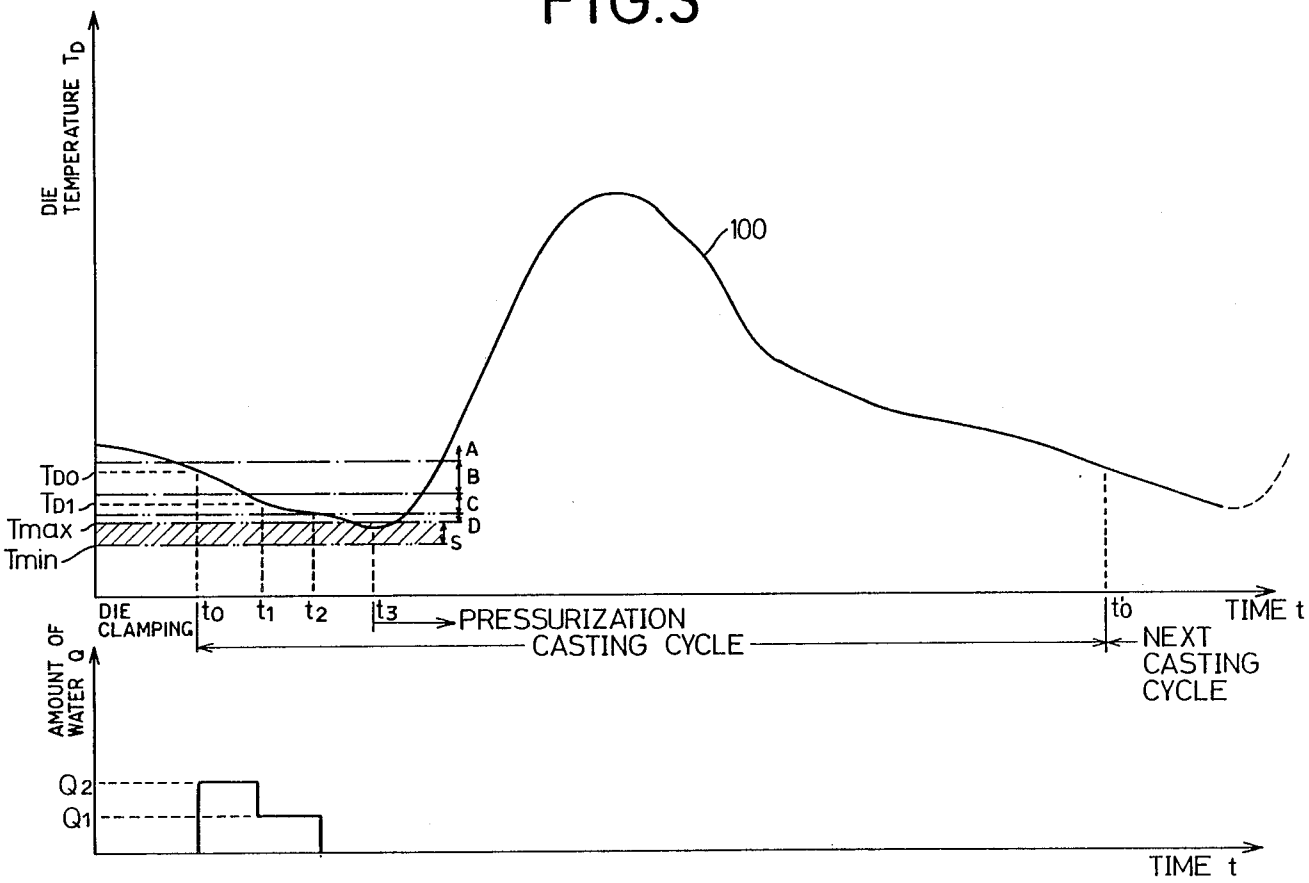
FIG. 3 is a timing chart showing a casing cycle based on the first die temperature control process.

A step I-1 detects the temperature $T_D$ of the die 12 immediately after it is clamped, from the output voltage of the temperature sensor 72 disposed in the lower die member 16. In a step I-2, the die temperature $T_D$ is introduced as temperature data into the microcomputer 78 through an interface (not shown). In the following description, the die temperature as data to be processed by the microcomputer 78 is indicated as being placed in parentheses. The CPU of the microcomputer 78 determines whether the die temperature ($T_D$) is in a preset temperature range S stored in the microcomputer 78 or not. The preset temperature range S has been experimentally established based on the casting conditions. When the die temperature ($T_D$) lies in the preset temperature range S, the casting die 12 is kept under an optimum temperature condition for pouring the molten metal into the die cavity 24. Specifically, the preset temperature range S is represented by a temperature range S between an upper limit temperature (Tmax) and a lower limit temperature (Tmin) shown in FIG. 3. FIG. 3 shows a die temperature curve 100 which indicates the actual die temperature $T_D$ as it varies with time.

If the die temperature ($T_D$) falls in the preset die temperature range S, then the step of forcing or filling the molten metal in the die cavity 24 under pressure in a step I-3.

If the die temperature ($T_D$) is not in the preset die temperature range S, then the die temperature is controlled so as to reach the preset die temperature range S in the following manner: In a step I-4, the CPU determines one of four temperature zones A, B, C, D which corresponds to the die temperature ($T_D$), the temperature zones A, B, C, D being established beforehand based on the preset die temperature range S. The temperature zones A through D are set dependent on the casting conditions to be employed. In the illustrated embodiment, these temperature zones A through D are established with respective suitable zone widths above the preset die temperature range S.

The amount of cooling water to be supplied to the die 12 is selected with respect to the respective temperature zones A through D as shown in Table 1, given below, which also indicate whether the solenoid-operated valves 84, 86 are to be opened or closed to supply the amount of cooling water.

TABLE 1

Temperature zones and amounts of cooling water

| Temperature zone | Amount of water | Solenoid valves SV84 | Solenoid valves SV86 |
|---|---|---|---|
| A | $Q_1 + Q_2$ | Open | Open |
| B | $Q_2$ | Close | Open |
| C | $Q_1$ | Open | Close |
| D | 0 | Close | Close |

The amounts $Q_1$, $Q_2$ of cooling water flowing through the solenoid-operated valves 84, 86 can be adjusted by the variable restriction valves 88, 90 disposed downstream of the solenoid-operated valves 84, 86, respectively. These amounts of cooling water are determined dependent on the desired casting conditions.

In a step I-5 which follows the step I-4, the amount of cooling water to be supplied is determined. In a following step I-5, the microcomputer 78 sends an opening or closing signal to the solenoid-operated valves 84, 86 to supply the determined amount of cooling water to the die 12. After the cooling water has been supplied for a preset time period in a step I-7, control returns from the step I-7 to the step I-1.

The casting cycle will be described with reference to the timing chart of FIG. 3. The CPU determines whether a die temperature ($T_{D0}$) detected in the step I-1 at a time $t_0$ immediately after the die 12 is clamped falls within the preset die temperature range S in the step I-2. Since the die temperature ($T_{D0}$) falls outside of the preset die temperature range S, the CPU then determines one of the temperature ranges A through D which contains the die temperature ($T_{D0}$) in the step I-4. Inasmuch as the die temperature ($T_{D0}$) corresponds to the temperature zone B at this time, the microcomputer 78 applies an opening signal to the solenoid-operated valves 86 and a closing signal to the solenoid-operated valve 84 to supply the amount $Q_2$ of cooling water to the die 12 in the steps I-5, I-6. As a consequence, cooling water supplied from the cooling water supply 74 through the pipe 82 is adjusted in quantity by the solenoid-operated valve 86 and the variable restriction valve 90, and then the amount $Q_2$ of cooling water is introduced into the pipes 61, 62. Therefore, the amount $Q_2$ of cooling water is supplied into the cooling holes 58, 60 in the cooling blocks 50, 52. After having passed through the cooling holes 58, 60, the cooling water is discharged via the pipes 63, 64 into the tanks 96, 100. The circulation of cooling water continues for a preset period of time, e.g., 1 minute, in the step I-7.

Then, control goes back to the step I-1 in which a die temperature ($T_{D1}$) is detected at a time $t_1$ by the temperature sensor 72. Since the die 12 has been cooled by the supplied cooling water, the die temperature ($T_{D1}$) is lower than the die temperature ($T_{D0}$) and falls in the temperature zone C as shown in FIG. 3. The temperature zone C is closer to the preset die temperature range S, and it is preferable in the temperature zone C that the die temperature ($T_D$) be lowered at a smaller gradient in order to prevent the die 12 from being excessively cooled below the preset die temperature range S. The CPU then executes the steps I-2, I-4, and the microcomputer 78 closes the solenoid-operated valve 86 and opens the solenoid-operated valve 84 in the steps I-5, I-6 to supply the amount $Q_1$ of cooling water which is smaller than the amount $Q_2$ of cooling water. The amount $Q_1$ of cooling water is continuously supplied into the cooling holes 58, 60 in the cooling blocks 50, 52 for the preset period of time in the step I-7.

Again, control goes back to the step I-1 to detect a die temperature ($T_{D2}$) at a time $t_2$. As shown in FIG. 3, the die temperature ($T_{D2}$) is lower than the die temperature ($T_{D1}$) and lies in the temperature zone D. The CPU then executes the steps I-2, I-4, and the microcomputer 78 closes the solenoid-operated valve 84 to stop the supply of cooling water into the cooling holes 58, 60 in the steps I-5, I-6. At this time, the temperature zone D is next to the preset die temperature range S. If cooling water were supplied, therefore, then the die 12 might be excessively cooled. The die temperature $T_D$ should be lowered into the preset die temperature range S by letting the die 12 radiate its heat without being forcibly cooled.

After the preset period of time has elapsed in the step I-7, control returns to the step I-1 in which a die temperature $T_{D3}$ is detected at a time $t_3$. At this time, the die temperature ($T_{D3}$) falls in the preset die temperature range S. Therefore, control goes from the step I-2 to the step I-3 which starts filling molten metal in the die cavity 24.

It can now be understood that according to the first die temperature control process, the casting die 12 is kept in a desired temperature range before molten metal is forced into the die cavity 24 under pressure. Therefore, the die temperature at the time the die 12 is clamped is prevented from becoming irregular because of different casting cycles.

When filling the die cavity 24 with molten metal, the second die temperature control process is carried out to select an optimum molten metal pressurizing pattern for the casting die 12 and a die cooling pattern corresponding to the selected molten metal pressurizing pattern.

Figure 4:
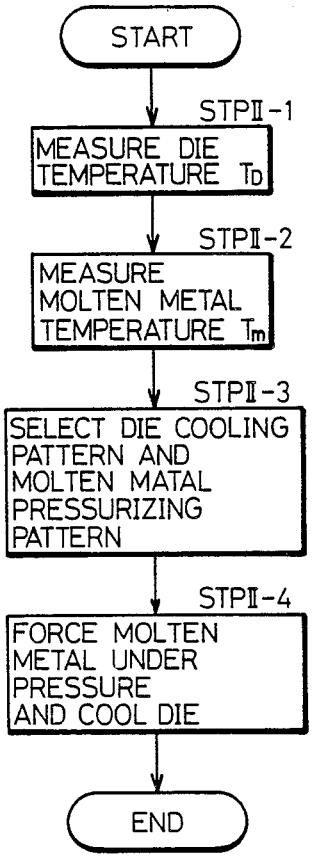
FIG. 4 is a flowchart of a sequence of a second die temperature control process of the die temperature control method.

FIG. 4 shows a sequence of the second die temperature control process. The ROM of the microcomputer 78 also stores a program containing instructions for the sequence of FIG. 4, and the CPU of the microcomputer 78 is operated by the stored program to carry out the sequence.

A step II-1 detects the temperature $T_D$ of the die 12 which falls in the preset die temperature range S. At this time, the die temperature ($T_{D3}$) in the preset die temperature range S is detected at $t_3$. At the same time, a molten metal temperature ($T_{m3}$) is detected by the second temperature sensor 73 disposed in the stalk 32 in a step II-2.

The molten metal temperature ($T_{m3}$) is introduced into the microcomputer 78 through an interface (not shown). In a step II-3, a molten metal pressurizing pattern and a die cooling pattern corresponding thereto, as shown in FIG. 6, are selected based on the die temperature ($T_{D3}$) and the molten metal temperature ($T_{m3}$).

Figure 5:
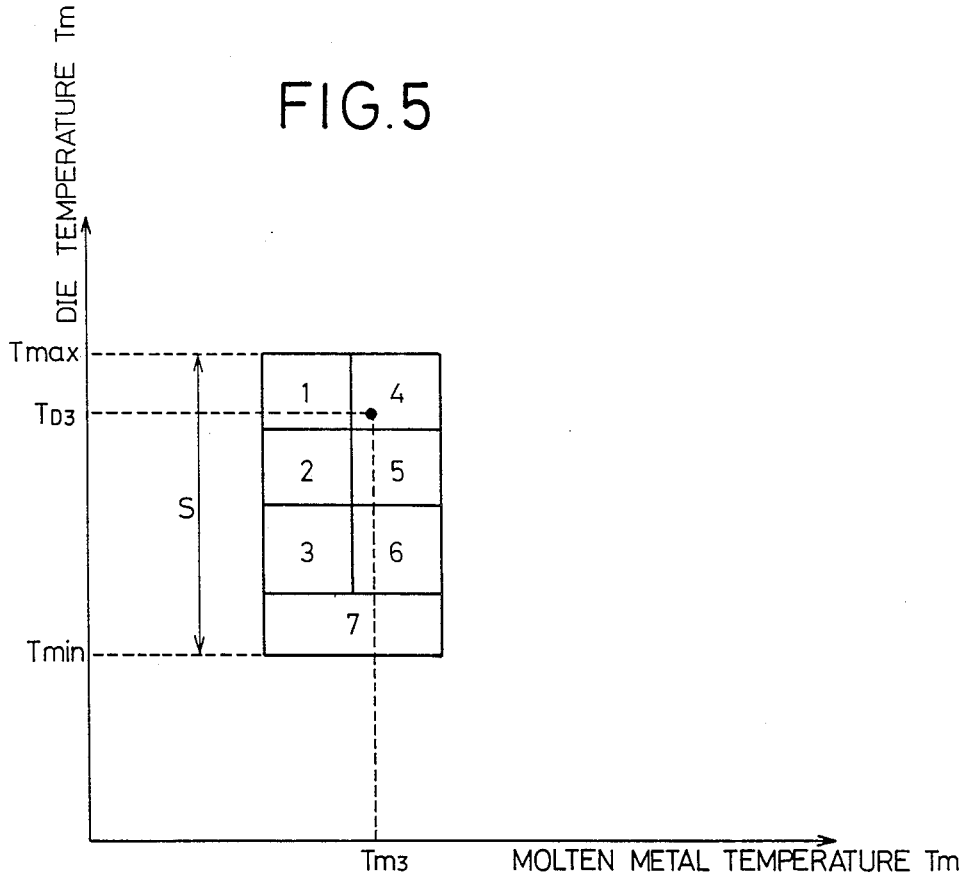
FIG. 5 is a graph showing the relationship between die temperatures and molten metal temperatures which are relied upon in selecting a molten metal pressurizing pattern and a die cooling pattern in the second die temperature control process.

FIG. 5 is a graph showing molten metal pressurizing patterns and die cooling patterns as related to the die temperature $T_D$ and the molten metal temperature $T_m$. Regions 1 through 7 shown in FIG. 5 correspond respectively to molten metal pressurizing patterns a through g and also to die cooling patterns $a_1$ through $g_1$ shown in FIG. 6. These regions 1 through 7, the molten metal pressurizing patterns a through g, and the die cooling patterns $a_1$ through $g_1$ are established in advance based on the casting conditions, and stored as data in the microcomputer 78. If the die temperature $T_{D3}$ and the molten metal temperature $T_{m3}$ correspond to the region 4, then a molten metal pressurizing pattern d and a die cooling pattern $d_1$ are selected.

Figure 6:
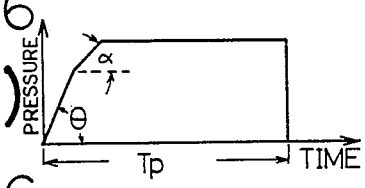
FIGS. 6 (*a*) through 6(*g*) and 6($a_1$) through 6($g_1$) shows graphs illustrating molten metal pressurizing patterns and die cooling patterns which are established dependent on the die temperature and the molten metal temperature.
Figure 6:
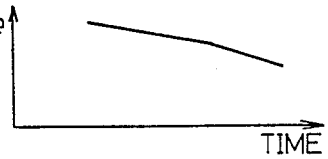
Figure 6:
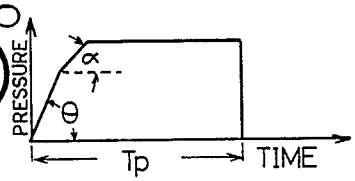
Figure 6:
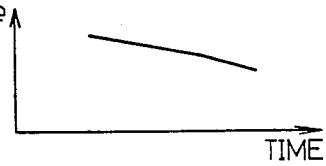
Figure 6:
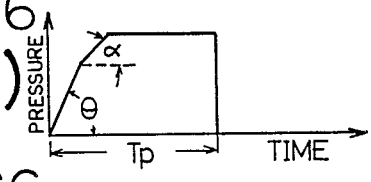
Figure 6:
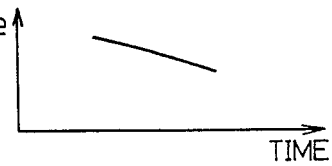
Figure 6:
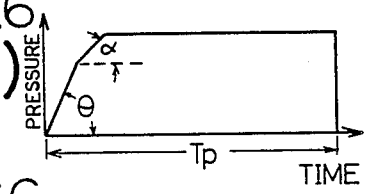
Figure 6:
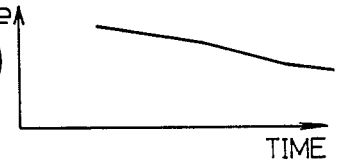
Figure 6:
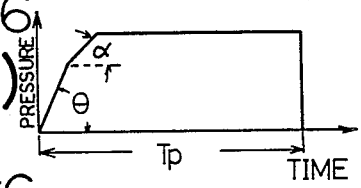
Figure 6:
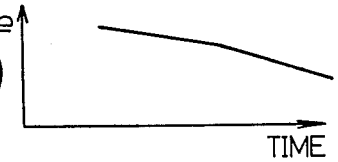
Figure 6:
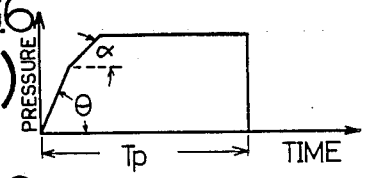
Figure 6:
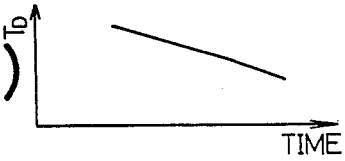
Figure 6:
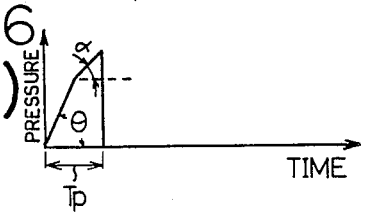
Figure 6:
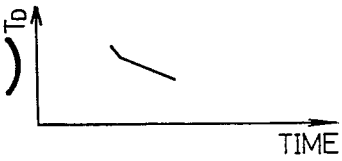

As can readily be understood from FIGS. 5 and 6, the higher the die temperature $T_D$ and the molten metal temperature $T_m$, the longer the time for pressurizing the molten metal, and the lower the die temperature $T_D$ and the molten metal temperature $T_m$, the shorter the time for pressurizing the molten metal. In the molten metal pressurizing patterns a through g, the speed tan $\theta$ at which the molten metal starts being poured into the die cavity 24 through the stalk 32 under pressure remains the same, and the speed tan $\alpha$ at which the molten metal is fed into the die cavity 24 until it is filled also remains the same.

Therefore, when the die temperature $T_D$ is higher, the molten metal pressurizing time is longer since a relatively long period of time is required for the molten metal to be solidified. Conversely, when the die temperature $T_D$ is lower, the molten pressurizing time is shorter as the molten metal can be solidified in a shorter period of time, thus shortening the casting cycle. In the region 7, the die temperature $T_D$ barely falls within the preset die temperature range S, but is too low to effect an actual casting cycle. In this case, the poured molten metal is kept in the die cavity 24 only for the purpose of keeping the die 12 at a temperature sufficient for a next casting cycle.

Figure 7:
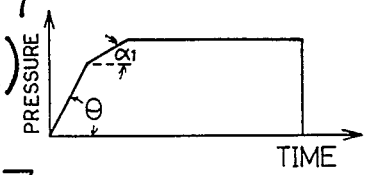
FIGS. 7(*h*) through 7(*n*) and 7($h_1$) through 7($n_1$) shows graphs illustrating other molten metal pressurizing patterns and die cooling patterns which are established dependent on the die temperature and the molten metal temperature.
Figure 7:
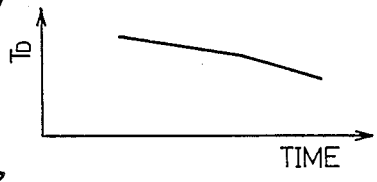
Figure 7:
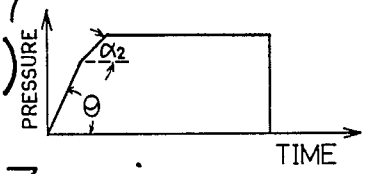
Figure 7:
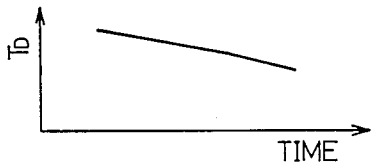
Figure 7:
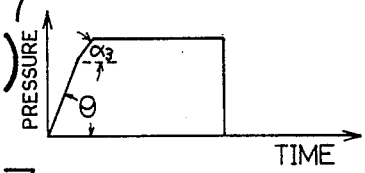
Figure 7:
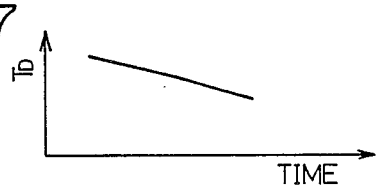
Figure 7:
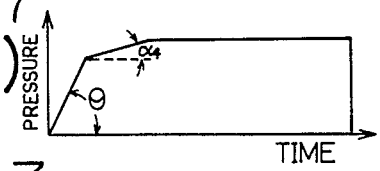
Figure 7:
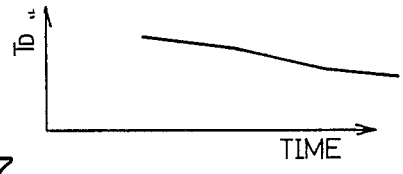
Figure 7:
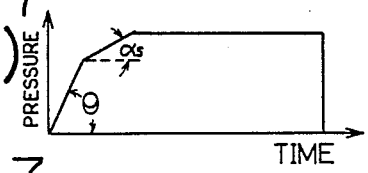
Figure 7:
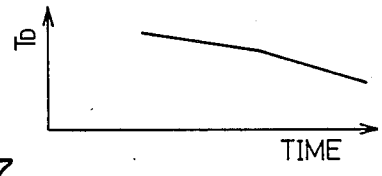
Figure 7:
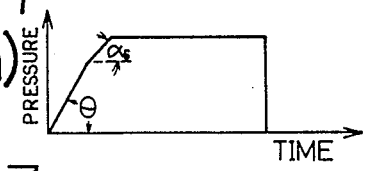
Figure 7:
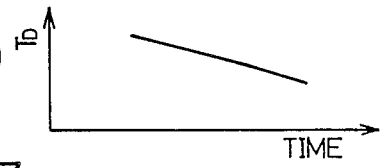
Figure 7:
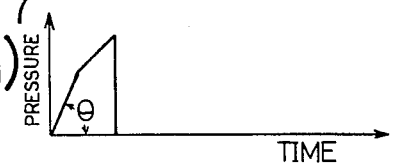
Figure 7:
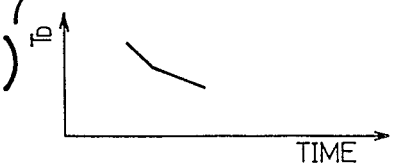

FIG. 7 shows alternative molten metal pressurizing patterns h through n and die cooling patterns $h_1$ through $n_1$ which may be employed instead of the molten metal pressurizing patterns a through g and the die cooling patterns $a_1$ through $g_1$ shown in FIG. 6. A study of FIGS. 5 and 7 indicates that when the die temperature $T_D$ and the molten metal temperature $T_m$ are higher, the speed at which the molten metal is fed into the die cavity 24 is made lower in order to prevent defects from being formed in a casting by a gas produced by too a rapid flow of molten metal. When the die temperature $T_D$ and the molten metal temperature $T_m$ are lower, the molten metal feeding speed is made higher to prevent casting defects or misruns which would be developed by incomplete distribution of the molten metal in the die cavity 24. For example, the molten metal pressurizing pattern h corresponds to the region 1 in FIG. 5, and the molten metal pressurizing pattern i corresponds to the region 2 in FIG. 5. The die temperature $T_D$ is higher in the region 1, and hence the molten metal feeding speed tan $\alpha_1$ in the molten metal pressurizing pattern h is selected to be lower than the molten metal feeding speed tan $\alpha_2$ in the molten metal pressurizing pattern i. The molten metal feeding speeds tan $\alpha_3$ through tan $\alpha_6$ in the molten metal pressurizing patterns j through m are similarly selected according to the regions 3 through 6.

Inasmuch as a molten metal pressurizing pattern and a die cooling pattern are selected dependent on the die temperature $T_D$ and the molten metal temperature $T_m$, various patterns can be selected to meet different conditions. In actual casting processes, however, a molten metal pressurizing pattern and a die cooling pattern may be selected only dependent on the die temperature $T_D$.

In a step II-4 (FIG. 4), the molten metal is filled according to the molten metal pressurizing pattern d selected in the step II-3 and the casting die 12 is cooled according to the die cooling pattern $d_1$ selected in the step II-3.

More specifically, when a start signal is applied from the microcomputer 78, the molten metal supply 34 is operated to pressurize the surface level of molten metal stored in the ladle (not shown) in the molten metal supply 34. The molten metal is fed via the stalk 32 into the die cavity 24 under a pressure according to the molten metal pressurizing pattern $d_1$. The casting die 12 is cooled such that the amount of cooling water supplied to the casting die 12 is controlled by the die temperature control apparatus 14 in order to vary the die temperature $T_D$ along the die cooling pattern $d_1$.

Figure 8:
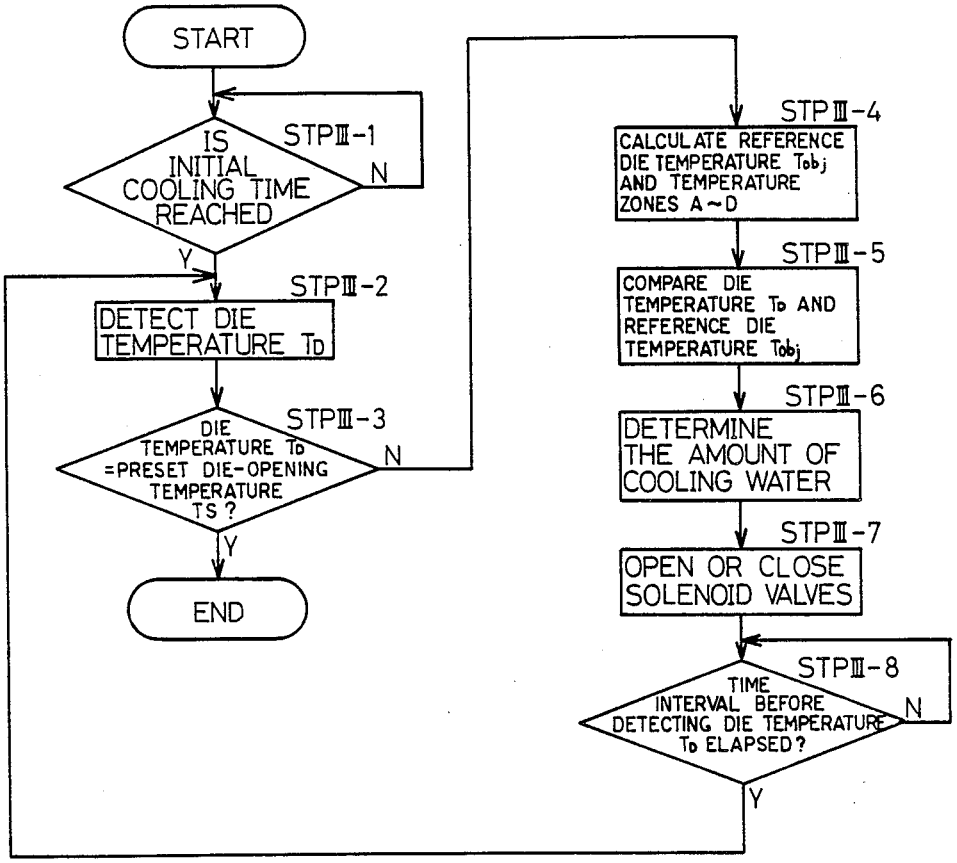
FIG. 8 is a flowchart of a sequence of a third die temperature control process of the die temperature control method.
Figure 9:
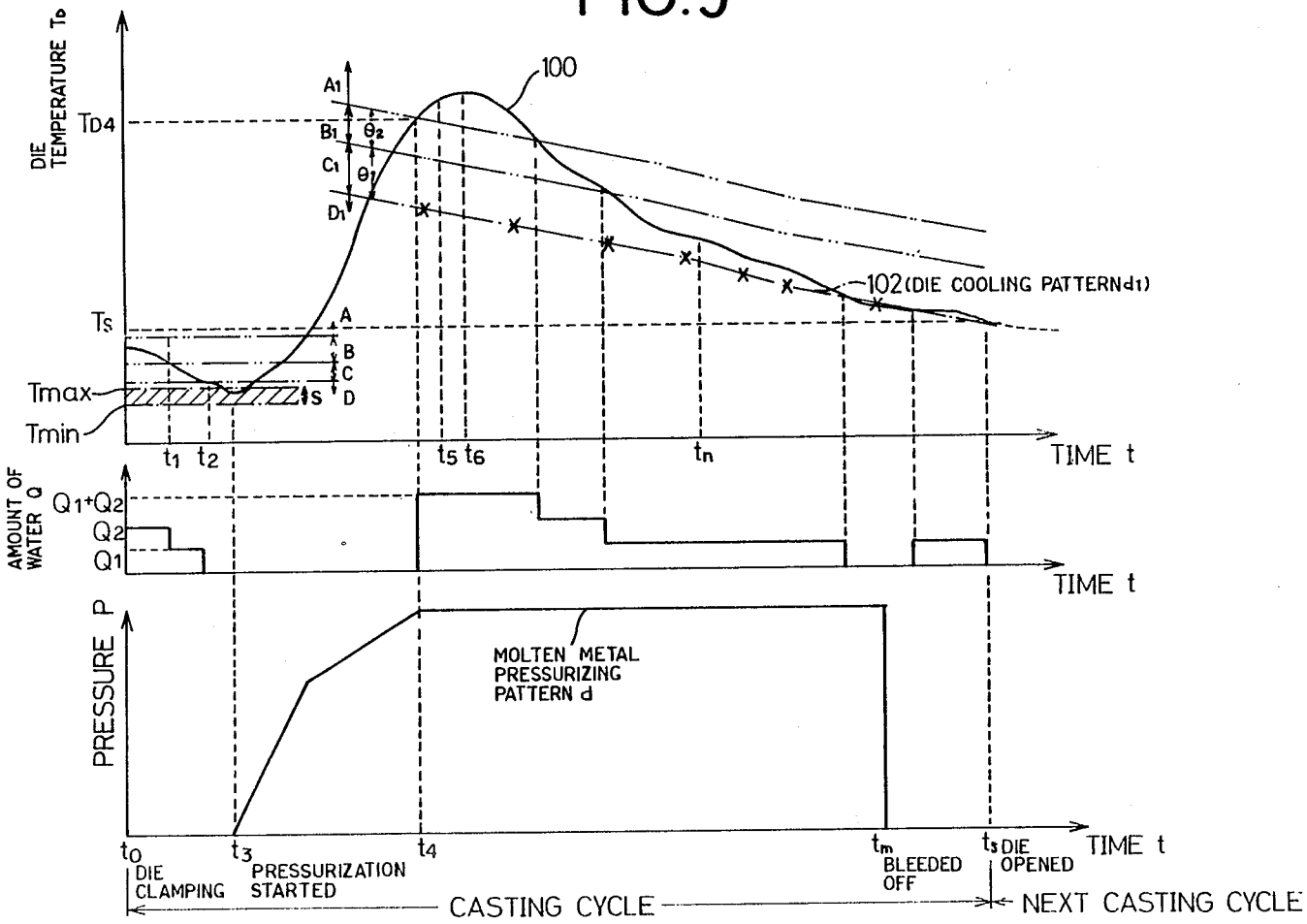
FIG. 9 is a timing chart showing a casing cycle based on the third die temperature control process.

More specifically, the casting die 12 is cooled according to the third die temperature process of the invention. FIG. 8 shows a sequence of the third die temperature control process. The ROM of the microcomputer 78 also stores a program containing instructions for the sequence of FIG. 8, and the CPU of the microcomputer 78 is operated by the stored program to carry out the sequence. FIG. 9 is a timing chart showing an example in which the third die temperature control process is carried out.

When a prescribed period of time has elapsed after the pressurization starting time $t_3$ and an initial cooling time $t_4$ for starting to cool the casting die 12 is reached in a step III-1, a die temperature ($T_{D4}$) at the time $t_4$ is detected by the temperature sensor 72 in a step III-2. The detected die temperature ($T_{D4}$) is introduced as temperature data into the microcomputer 78 through the interface (not shown). After the time $t_4$, the molten metal in the die cavity 24 is kept under a prescribed pressure, i.e., 0.28 kg/cm$^2$ in the embodiment, and is cooled and solidified.

In a step III-3, the CPU in the microcomputer 78 compares the die temperature ($T_{D4}$) and a preset die-opening temperature (Ts) established beforehand based on the casting conditions and stored in the microcomputer 78. Since the die temperature ($T_{D4}$) cannot be equal to the die-opening temperature (Ts) immediately after the casting cycle has been started, control goes from the step III-3 to a step III-4.

In the step III-4, a reference die temperature (Tobj) is calculated on the basis of a reference die cooling curve 102 corresponding to the die cooling pattern $d_1$, and temperature zones $A_1$ through $D_1$ having certain respective widths for determining an amount of cooling water based on the reference die temperature (Tobj) are calculated. A plurality of temperature data corresponding to the die cooling pattern $d_1$ plotted in FIG. 9 at (a) are stored in the microcomputer 78. Based on these stored temperature data, the reference die cooling curve 102 is established as a function of time t and the die temperature ($T_D$), i.e., $T=f(t)$.

The reference die temperature (Tobj) and the temperature zones $A_1$ through $D_1$ are calculated by the CPU in the microcomputer 78 as follows:

(1) The reference die temperature (Tobj) at a time t is calculated from the function $T=f(t)$ representing the reference die cooling curve 102.

(2) Based on the reference die temperature (Tobj), the following temperature ranges are used as the temperature zones $A_1$ through $D_1$:

$$A_1: T_D \geqq Tobj+\theta_1+\theta_2$$

$$B_1: Tobj+\theta_1 \leqq T_D < Tobj+\theta_1+\theta_2$$

$$C_1: Tobj < T_D < Tobj+\theta_1$$

$$D_1: T_D \leqq Tobj$$

where $\theta_1$, $\theta_2$ are constants representing temperature ranges which are selected based on the casting conditions.

The measured die temperature ($T_{D4}$) is compared with the reference die temperature (Tobj) by the CPU in the microcomputer 78, and it is determined in which one of the temperature zones $A_1$ through $D_1$ the die temperature ($T_{D4}$) is included. The amount of cooling water to be supplied is determined dependent on the temperature zone in which the die temperature ($T_{D4}$) falls, in a step III-6. The solenoid valves 84, 86 are opened and closed and cooling water is supplied in the amounts as indicated by the above Table 1 dependent on the temperature zones $A_1$ through $D_1$. The higher the die temperature $T_D$, the greater the amount of cooling water supplied.

Based on the results obtained in the steps III-5, III-6, the microcomputer 78 sends an opening signal or a closing signal to the solenoid valves 84, 86 in a step III-7. In FIG. 9, the die temperature ($T_{D4}$) at the time $t_4$ falls in the temperature zone $A_1$. Therefore, the solenoid valves 84, 86 are opened by the opening signal from the microcomputer 78 to supply the amount $Q_1+Q_2$ to the die 12.

Cooling water supplied from the cooling water supply 74 flows through the variable restriction valves 88, 90 and is introduced in the amount $Q_1+Q_2$ from the pipes 61, 62 into the cooling passages 58, 60 in the cooling blocks 50, 52. After the supply of cooling water has been continued for a preset period of time in a step III-8 until a die temperature ($T_{D5}$) is detected next time, control goes back to the step III-2.

The flowchart of FIG. 8, i.e., the sequence from the step III-2 to the step III-8, is repeated at times $t_5$, $t_6$, . . . $t_n$, . . . with prescribed time intervals therebetween. The amounts of cooling water supplied from the cooling water supply 74 in one casting cycle are shown in FIG. 9 at (b). The die 12 is thus cooled by the supplied cooling water so that the die temperature ($T_D$) varies according to the die temperature curve 100 shown in FIG. 9 at (a). After a time $t_m$ in the casting cycle, the pressurization of the molten metal in the die cavity 24 is stopped.

Finally, when the die-opening temperature (Ts) is reached at a time $t_s$, the die 12 is opened in the step III-3, and the produced casting is removed from the die 12.

By thus determining the amount of cooling water based on the reference die cooling curve 102 and repeating the operation at predetermined intervals, the proper amount of cooling water can be supplied to the casting die 12. Therefore, it can be understood that the actual cooling of the casting die 12 can reliably be controlled.

With the present invention, as described above, before a casting cycle is started, a die temperature detected by the temperature sensor and a preset die temperature range established beforehand based on casting conditions are compared, and cooling water is supplied in amounts which are selected based on the result of the comparison in order to bring the die temperature into the preset temperature range. Therefore, the die temperature is controlled so as to fall in the preset die temperature range at all times when filling molten metal into the die cavity, so that the casting die can be maintained under certain temperature conditions even if casting cycles vary from each other.

Molten metal pressurizing patterns and die cooling patterns are established in advance dependent on die temperatures. When filling molten metal in the die cavity, one of the molten metal pressurizing patterns which corresponds to the detected die temperature and one of the die cooling patterns which corresponds to the detected die temperature are selected, and the molten metal is filled under a pressure according to the selected molten metal pressurizing pattern and the amount of cooling water according to the selected die cooling pattern is supplied to the die. By selecting the molten metal pressurizing pattern, a time period for pressurizing the molten metal is selected which corresponds to the die temperature. The speed at which the molten metal is fed into the die cavity, which is indicated by each of the molten metal pressurizing patterns, is established dependent on the die temperature for thereby filling the molten metal in the die cavity at a optimum speed matching casting conditions. It is thus possible to carry out a casting cycle effectively while eliminating wasteful solidification time, and also to prevent casting defects caused in a casting by a gas produced in the die cavity and casting defects such as misruns. The above process is reliably assured by selecting one of the molten metal pressurizing patterns and a corresponding one of the die cooling patterns. Accurate die temperature control is made possible by establishing the molten metal pressurizing patterns and the die cooling patterns dependent on molten metal temperatures as well as die temperatures.

After the molten metal has been filled in the die cavity, the actual die temperature and a reference die temperature calculated from a reference die cooling curve are compared with each other, the amount of cooling water which is determined based on the result of the temperature comparison is supplied to the die, and the die is cooled so that the actual die temperature will approach the reference die cooling curve, in order to allow the molten metal to be cooled and solidified according to the selected die cooling pattern. Consequently, the manner in which the molten metal is solidified in the die cavity is properly controlled to achieve directional solidification of the molten metal with ease.

According to the present invention, therefore, castings of uniform and excellent quality can be produced.

Although a certain preferred embodiment has been shown and described, it should be understood that many changes and modifications may be made therein without departing from the scope of the appended claims.

What is claimed is:

1. A method of controlling the temperature of a casting die in a low-pressure casting process, the casting process pressurizing the surface of molten metal in a die cavity defined in the casting die, said method comprising the steps of:

detecting the temperature of said casting die before the molten metal is filled in said die cavity under pressure;

establishing a preset reference die temperature range and a plurality of temperature zones higher than said preset reference die temperature range;

comparing said detected temperature of the casting die and the preset reference die temperature range to determine whether said detected temperature falls within one of the preset reference die temperature range or a zone of the plurality of temperature zones;

controlling an amount of cooling water for each casting to be supplied to said casting die based on the result of the comparing step, said amount of cooling water being varied in response to the result of the comparing step;

repeating the step of comparing if a previously detected temperature fell within a selected zone of the plurality of temperature zones and thereafter repeating the step of controlling the amount of cooling water to be supplied to the cooling die dependent on which one of the temperature zones said detected temperature falls within; and starting to fill the molten metal in said die cavity when said detected temperature of the casting die falls in said preset reference die temperature range.

2. The method as recited in claim 1, wherein the step of controlling varies the amount of cooling water between at least one of maximum flow, zero flow and an intermediate flow, said intermediate flow being between the maximum flow and the zero flow.

3. The method as recited in claim 2, further comprising the step of using heat radiation from the casting die during zero flow to enable the detected temperature of the casting die to fall to the preset reference die temperature range.

4. The method as recited in claim 1, further comprising the step of using heat radiation from the casting die to enable detected temperature of the casting die to fall to the preset reference die temperature range.

5. The method as recited in claim 1, wherein the step of controlling further comprises the step of using a plurality of solenoid valves and variable restriction valves for controlling the amount of cooling water.

6. The method as recited in claim 1, wherein four temperature zones are used as the plurality of temperature zones higher than said preset reference die temperature range, the method further comprising the step of setting the four temperature zones based on casting conditions to be employed.

7. The method as recited in claim 6, wherein the four temperature zones have a first temperature zone which is greater than a second temperature zone which is greater than a third temperature zone which is greater than a fourth temperature zone and wherein the step of controlling further varies the amount of cooling water to supply a maximum amount of cooling water to the die when the detected temperature of the casting die falls in the first temperature zone, an intermediate amount of cooling water to the die when the detected temperature of the casting die falls in the second temperature zone, a minimal amount of cooling water to the die when the detected temperature of the casting die falls in the third temperature zone and fails to supply cooling water to the die when the detected temperature of the casting die falls in the fourth temperature zone.

8. A method of controlling the temperature of a casting die in a low-pressure casting process, the casting process for pressurizing the surface of molten metal stored in a closed container to fill the molten metal in a die cavity defined in the casting die, said method comprising the steps of:

detecting the temperature of said casting die when the molten metal is filled in said die cavity under pressure;

selecting, dependent on said detected temperature of the casting die, an optimum one of a plurality of molten metal pressurizing patterns established dependent on die temperatures and an optimum one of a plurality of die cooling patterns established dependent on die temperatures;

filling and holding the molten metal in said die cavity under a pressure according to the selected molten metal pressurizing pattern; and supplying said casting die with an amount of cooling water which is variably controlled according to the selected die cooling pattern.

9. A method according to claim 8, wherein said molten metal pressurizing patterns are established such that a time period for pressurizing the molten metal is shorter when the die temperature is lower, and is longer when the die temperature is higher.

10. The method according to claim 8, wherein said molten metal pressurizing patterns are established such that a speed at which the molten metal is fed into said die cavity is higher when the die temperature is lower, and is lower when the die temperature is higher.

11. The method according to any one of claims 8 through 10, wherein the temperature of the casting die and the temperature of the molten metal are detected, and an optimum one of the molten metal pressurizing patterns and an optimum one of the die cooling patterns are selected dependent on said detected temperature of the casting die and said detected temperature of the molten metal.

12. The method as recited in claim 8, wherein the step of supplying an amount of cooling water is carried out for each casting process.

13. The method as recited in claim 8, wherein the step of selecting further comprises the steps of comparing the detected die temperature against temperature of the molten metal and determining where the result of the comparing falls within one of a plurality of regions, a predetermined number of the regions being used and the same predetermined number of molten metal pressurizing patterns and die cooling patterns being used, each of said regions having one corresponding molten metal pressurizing pattern and die cooling pattern, the selecting of the optimum molten metal pressurizing pattern and die cooling pattern being based on the region in which the result falls.

14. The method as recited in claim 13, wherein one of the regions is for a die temperature too low to effect casting, said molten metal pressurizing pattern and die cooling pattern corresponding to this region resulting in poured molten metal being kept in the die for a time sufficient to maintain the temperature for a next casting cycle.

15. The method as recited in claim 13, wherein the predetermined number of regions is seven and wherein a first region represents a range of die temperatures higher than a second region and the second region represent a range of die temperatures higher than a third region, the first, second and third regions each representing the same first region of molten metal temperatures, a fourth region represents the same range of die temperatures as to the first region, a fifth region represents the same range of die temperatures as the second region and a sixth region represents the same range of die temperatures as the third region, the fourth, fifth and sixth regions each representing the same second region of molten metal temperatures, the second region of molten metal temperatures being greater than the first region of molten metal temperatures and a seventh region representing a range of die temperatures less than all other ranges but representing a region of molten metal temperatures of the first and second region of molten metal combined and wherein the step of determining uses the seven regions to select the optimum molten metals pressurizing pattern and die cooling pattern.

16. The method as recited in claim 15, wherein the molten metal pressurizing pattern and die cooling pattern corresponding to the fourth region is the longest time for pressurizing molten metal and the longest time for cooling the die as compared to the remaining regions.

17. The method as recited in claim 15, wherein the time for pressurizing molten metal is greatest for the fourth region, the times for pressurizing molten metal for the first and fifth regions are less than the time for the fourth region but greater than the time for the second and sixth regions and the time for pressurizing molten metal for the third region is less than the times for the second and sixth regions but greater than the time for the seventh region.

18. The method as recited in claim 15, wherein the time for cooling the die is greatest for the fourth region, the times for cooling the die for the first and fifth regions are less than the time for the fourth region but greater than the times for the second and sixth regions, and the time for cooling the die for the third region is less than the times for the second and sixth regions but greater than the time for the seventh region.

19. The method as recited in claim 15, further comprising the step of varying the speed at which the molten metal is fed based on the region selected, the molten metal being fed at the slowest for the fourth region, the speeds for feeding the molten metal for the first and fifth regions are faster than the speed for the fourth region but slower than the speeds for the second and sixth regions and the speed for feeding the molten metal for the third region being faster than the speeds for the second and sixth regions but less than the speed for the seventh region.

20. The method as recited in claim 15, further comprising the step of initially feeding the molten metal to the die at a constant speed for a predetermined initial period of time regardless of the region selected and then varying the speed after the predetermined initial period of time.

21. A method of controlling the temperature of a casting die in a low-pressure casting process, the casting process pressurizing the surface of molten metal stored in a closed container to fill the molten metal in a die cavity defined in the casting die, said method comprising the steps of:

detecting the temperature of said casting die after the molten metal is filled in said die cavity under pressure;

determining a reference die temperature corresponding to said detected temperature of the casting die from a predetermined die cooling curve, said predetermined die cooling curve varying as a function of time and die temperatures;

selecting an amount of cooling water to be supplied to said die cavity based on the difference between said detected temperature of the casting die and said reference die temperature; and supplying said selected amount of cooling water to said casting die to cool the casting die according to said die curve.

22. The method according to claim 21, further comprising the steps of lowering the temperature of said casting die to a prescribed die-opening temperature by repeatedly detecting the temperature of the casting die at prescribed intervals of time after the molten metal is filled in said die cavity, repeatedly comparing the temperature of the casting die and said reference die temperature and based on the repeated detecting and comparing, supplying a varying amount of cooling water to the casting die.

23. The method as recited in claim 21, wherein a plurality of temperature ranges are defined based on the temperature of the predetermined die cooling curve, the method further comprising the step of varying the amount of cooling water supplied dependent upon which one of the plurality of temperature ranges the detected die temperature falls within.

24. The method as recited in claim 23, wherein four temperature ranges are used and further comprising the steps of defining a first temperature range to be greater than or equal to the temperature of the predetermined die cooling curve plus $\theta_1$, plus $\theta_2$, defining a second temperature range to be greater than or equal to the temperature of the predetermined die cooling curve plus $\theta_1$ but less than the temperature of the predetermined die cooling curve plus $\theta_1$ plus $\theta_2$, defining a third temperature range to be greater than the temperature of the predetermined die cooling curve but less than the temperature of the predetermined die cooling curve plus $\theta_1$ and defining a fourth temperature range to be greater than or equal to the temperature of the predetermined die cooling curve wherein $\theta_1$ and $\theta_2$ are constants representing temperature ranges selected based on casting conditions.

25. The method as recited in claim 23, wherein the step of varying the amount of cooling water results in a maximum amount of cooling water being supplied when the die temperature is in the first temperature range, an intermediate amount of cooling water being supplied when the die temperature is in the second temperature range, a minimal amount of cooling water being supplied when the die temperature is in the third temperature range and cooling water failing to be supplied when the die temperature is in the fourth temperature range.

26. The method as recited in claim 25, further comprising the step of decreasing the predetermined die cooling curve over time after the molten metal has been filled in the correspondingly to the decrease in the predetermined die cooling curve.

27. The method as recited in claim 21, further comprising the step of varying the amount of cooling water during the supplying, the amount of cooling water being varied between at least one of maximum flow, zero flow and an intermediate flow, said intermediate flow being between the maximum flow and the zero flow.

28. The method as recited in claim 21, further comprising the step of using heat radiation from the casting die to enable the die temperature to fall to the temperature on the predetermined die cooling curve for that period of time.

29. An apparatus for controlling the temperature of a casting die so as to fall in a prescribed temperature range by supplying cooling water to the casting die in a low-pressure casting process for pressurizing the surface of molten metal stored in a closed container with a gas under pressure to fill the molten metal in a die cavity defined in the casting die, said apparatus comprising:

a temperature sensor disclosed in said casting die for detecting the temperature of the casting die;

flow control means comprising a fluid circuit including a solenoid valve and a variable restriction valve for determining an amount of cooling water to be supplied to the casting die for each casting process; and a microcomputer for controlling said solenoid-operated valve based on a signal applied from said temperature sensor;

wherein said casting die further comprises an upper die member, a lower die member and two slidable die members, said two slidable die members each having a cooling block therein, said fluid circuit of the flow control means passing through the two cooling blocks and said fluid circuit comprises a pipe extending from a cooling water supply, said pipe having a solenoid valve and a variable restriction valve to supply cooling water to both cooling blocks of the two slidable die members.

30. The apparatus as recited in claim 29, further comprising a stalk for supplying the molten metal to the die cavity and a second temperature sensor disposed in said stalk, the temperature sensor in the casting die and the second temperature sensor being the only temperature sensors in the apparatus.

31. The apparatus as recited in claim 29, wherein the pipe extending from the cooling water supply is branched into two secondary pipes each having respective solenoid valves and variable restriction valves, the two secondary pipes being rejoined downstream of the variable restriction valves to supply cooling water to both cooling blocks of the two slidable die members.

32. The apparatus as recited in claim 31, further comprising flow meters located in each of the two, secondary pipes downstream of the variable restriction valves.

33. A method of controlling the temperature of a casting die in a low-pressure casting process, the casting process pressuring the surface of molten metal stored in a closed container to fill the molten metal in a die cavity defined in the casting die, said method comprising the steps of:

setting a plurality of temperature zones and a reference die temperature range based on casting conditions to be employed;

detecting the temperature of said casting die before the molten metal is filled in said die cavity under pressure;

comparing the detected temperature of the casting die with the reference die temperature range to determine whether said detected temperature falls within the preset reference die temperature range or one of the plurality of temperature zones;

supplying a variable amount of cooling water for each casting to the casting die when the comparing determines the die temperature to be above the reference die temperature range and in one of the plurality of temperature zones, the amount of cooling water supplied being dependent upon which temperature zone the die temperature falls within; and starting to fill the molten metal in said die cavity when said detected temperature of the casting die falls within said reference die temperature range.

34. The method as recited in claim 33, wherein four temperature zones are used as the plurality of temperature zones and further comprising the step of repeating the detecting, comparing and supplying until the die temperature falls within the reference die temperature range.

35. The method as recited in claim 34, wherein the four temperature zones are sequentially greater temperature zones and further comprising the step of solely using heat radiation from the casting die to lower the detected die temperature to the reference die temperature when the detected die temperature is in the lowest of the four temperature zones.

36. A method of controlling the temperature of a casting die in a low-pressure casting process, the casting process pressurizing the surface of molten metal stored in a closed container to fill the molten metal in a die cavity defined in the casting die, said method comprising:

(A) the steps before supplying molten metal to the die of:

detecting the temperature of said casting die before the molten metal is filled in said die cavity under pressure;

comparing said detected temperature of the casting die and a preset reference die temperature range to determine whether said detected temperature falls within the preset reference die temperature range;

controlling an amount of cooling water to be supplied to said casting die based on the result of the comparing step; and starting to fill the molten metal in said die cavity when said detected temperature of the casting die falls in said preset reference die temperature range;

(B) the steps during supplying of molten metal to the die of:

detecting the temperature of said casting die when the molten metal is filled in said die cavity under pressure;

selecting, dependent on said detected temperature of the casting die, an optimum one of a plurality of molten metal pressurizing patterns established dependent on die temperatures and an optimum one of a plurality of die cooling patterns established dependent on die temperatures;

filling and holding the molten metal in said die cavity under a pressure according to the selected molten metal pressurizing pattern; and supplying said casting die with an amount of cooling water which is variably controlled according to the selected die cooling pattern; and (C) the steps after the die is filled with molten metal of:

detecting the temperature of said casting die after the molten metal is filled in said die cavity under pressure;

determining a reference die temperature corresponding to said detected temperature of the casting die from a predetermined die cooling curve;

selecting an amount of cooling water to be supplied to said die cavity based on the difference between said detected temperature of the casting die and said reference die temperature; and supplying said selected amount of cooling water to said casting die to cool the casting die according to said die cooling curve.

37. The method as recited in claim 36, wherein the controlling during the steps (A) and the selecting during the steps (C) utilize a plurality of temperature zones, the amount of cooling water supplied to the die cavity being based on which zone the detected die temperature falls within.

38. The method as recited in claim 37, wherein four temperature zones are used in steps (A) and in steps (C), the temperature zones in steps (A) staying constant over time while the temperature zones in steps (C) decrease from a time the die is filled with molten metal.

39. The method as recited in claim 36, wherein the four temperature zones for the steps (A) are such that a first temperature zone is greater than a third temperature zone which is greater than a fourth temperature zone and wherein the step of controlling further varies the amount of cooling water to supply a maximum amount of cooling water to the die when the detected temperature of the casting die falls in the first temperature zone, an intermediate amount of cooling water to the die when the detected temperature of the casting die falls in the second temperature zone, a minimal amount of cooling water to the die when the detected temperature of the casting die falls in the third temperature zone and fails to supply cooling water to the die when the detected temperature of the casting die falls in the fourth temperature zone.

40. The method as recited in claim 36, wherein the molten metal pressurizing the patterns of the steps (B) are established such that a time period for pressurizing the molten metal is shorter when the die temperature is lower, and is longer when the die temperature is higher.

41. The method as recited in claim 36, wherein the molten metal pressurizing patterns of the steps (B) are established such that a speed at which the molten metal is fed into said die cavity is higher when the die temperature is lower, and is lower when the die temperature is higher.

42. The method as recited in claim 36, wherein the temperature of the casting die and the temperature of the molten metal are detected during the steps (B), and an optimum one of the molten metal pressurizing patterns and an optimum one of the die cooling patterns are selected dependent on said detected temperature of the casting die and said detected temperature of the molten metal.

43. The method as recited in claim 36, further comprising in the steps (C), the step of lowering the temperature of the casting die to a prescribed die-opening temperature by repeatedly detecting the temperature of the casting die at prescribed intervals of time after the molten metal is filled in said die cavity, repeatedly comparing the temperature of the casting die and said reference die temperature and based on the repeated detecting and comparing, supplying a varying amount of cooling water to the casting die.

* * * * *